United States Patent [19]

Nowak

[11] Patent Number: 4,498,640

[45] Date of Patent: Feb. 12, 1985

[54] APPARATUS AND METHOD FOR UNIFORMLY WINDING ELONGATE SHEET MATERIALS

[75] Inventor: Frank J. Nowak, Toledo, Ohio

[73] Assignee: Owens-Illinois, Inc., Toledo, Ohio

[21] Appl. No.: 375,155

[22] Filed: May 5, 1982

[51] Int. Cl.[3] ..... B65H 17/02; B65H 19/04; B65H 57/28

[52] U.S. Cl. ..... 242/67.1 R; 242/56.9; 242/158.1; 242/DIG. 2

[58] Field of Search ..... 242/56.9, 157.1, 158.1, 242/158.5, 67.1 R, DIG. 2

[56] References Cited

U.S. PATENT DOCUMENTS

| | | | |
|---|---|---|---|
| 1,267,080 | 3/1918 | Judelshon | 242/158.5 X |
| 3,367,602 | 2/1968 | Mörling | 242/158.1 |
| 3,877,655 | 4/1975 | Cardinal et al. | 242/67.1 R |
| 3,997,122 | 12/1976 | Helfand et al. | 242/DIG. 2 X |

*Primary Examiner*—Stuart S. Levy
*Assistant Examiner*—Joseph J. Hail, III
*Attorney, Agent, or Firm*—Thomas L. Farquer; M. E. Click

[57] ABSTRACT

An apparatus for uniformly winding elongate sheets of punched material, typically used for grouping and packaging beverage containers, includes a reciprocating shuttle which evenly distributes the material as it is wound on a reel. The shuttle includes a plurality of adjacent sheet receiving slots which permit simultaneous reciprocation and even winding of a like plurality of sheets and a moveable elongate guide member which is moveable between a raised loading position and a lowered, retaining position. Mechanism is also included which permits adjustment of the reciprocatory stroke of the shuttle as well as of the center about which such reciprocation occurs.

12 Claims, 6 Drawing Figures

APPARATUS AND METHOD FOR UNIFORMLY WINDING ELONGATE SHEET MATERIALS

BACKGROUND OF THE INVENTION

The invention relates generally to winding equipment and more specifically to a method and apparatus for uniformly winding elongate sheets of material onto hubs or reels.

The diversity and specialization of packaging materials generally necessitates that they be manufactured at a site distinct from their site of utilization. For example, the mills which produce cardboard boxes and plants which produce molded containers, almost without exception, are distinct and distant from the sites at which products are placed in such containers. This rather obvious business reality encourages manufacturers of containers or packaging material to routinely examine how a given material may be compacted, collapsed or in some other fashion rendered more dense in order to improve the economics of transporting same from the manufacturing site to the utilization site. Due to this and other considerations, the design phase of preparing such material for shipment and the equipment related thereto has become a technology in itself.

A typical example of a package or packaging material which is fabricated at one location and shipped to another for application is the plastic carrier utilized for grouping six or eight beverage containers such as metal cans or glass bottles into a readily grippable and transportable package. The plastic carrier is manufactured in a continuous elongate sheet having spaced-apart apertures punched therein which both receive the beverage containers and define straps or webs which are readily engaged by the fingers of a hand. The plastic sheet is punched and prepared in a continuous length and then cut and reeled onto hubs or reels for shipment to a beverage bottler or similar facility where the sheet is cut into short lengths and installed upon groupings of bottles or containers.

Upon cursory examination, the operation of coiling the lengthy sheets or strips of the plastic material onto reels or hubs would appear to be simple and without difficulty. Upon closer examination, however, it will be appreciated that the material subsequent to punching more resembles lattice-work than a sheet, i.e., more of the material has been removed by the punching operation than remains. The material therefore lacks lateral and diagonal stability and exhibits uneven and unpredictable winding characteristics. Depending upon the amount of material remaining and thus the structural integrity of the sheet, an acceptable wind can sometimes be achieved by careful and accurate sizing of the internal width of the hub to the width of the elongate carrier sheet. Such a step is an obvious and relatively simple expedient to ensure that the strip does not skew, fold or slip inwardly along one edge toward the core of the hub or reel.

This approach, however, may not be successful if the ratio of the amount of removed material to that remaining is high. In this case, random stacking of punched area upon punched area, punched area upon web and web upon web results and causes highly irregular diametral variation as the material winds onto a reel. Aside from the obvious unattractiveness of such a wind, the diametral variation can create difficulties during the packaging process when the material is unreeled, can result in a reduction in the total length of material disposed upon a reel and, finally, can render the material difficult to use since it may eventually warp or deform from the desired planar configuration if stored in this condition. While it is true that as the material winds onto the reel, the length of a single wind, i.e., the circumference, slowly increases as the radius from the center of the reel or hub increases, this slowly changing parameter has generally been found to exacerbate the problem of radially uneven winding rather than reduce it.

SUMMARY OF THE INVENTION

The instant invention is directed to an apparatus and method for winding elongate sheets or strips of material onto reels or hubs in a uniform and even manner. The invention is specifically intended for use with beverage container packaging materials which have been formed by punching a plurality of container receiving openings in a substantially elongate sheet of material but may be readily adapted for use with similar elongate sheets or strips of material as will become apparent. The device comprehends a reciprocating shuttle which is disposed adjacent the material receiving reels at the end of the strip production line. The shuttle includes a plurality of material receiving channels oriented perpendicularly to the direction of reciprocation. The shuttle reciprocates laterally as the strip material is wound onto the reel, uniformly distributing the material onto the reel and controlling skewing of the material while substantially eliminating diametral variation of the wind. Such elimination of diametral variation is achieved by ensuring slight misalignment of apertures and webs in adjacent layers of the carrier sheet. A movable cross bar lowers to retain the material within the channels and raises to facilitate threading the material through the shuttle. Inasmuch as a typical machine for fabricating such continuous, punched sheets will produce a plurality of four strips simultaneously in a side-by-side fashion, a shuttle according to the instant invention preferably includes a like plurality of slots which receive the strips and simultaneously reciprocate them as they are wound onto reels.

Thus it is an object of the instant invention to provide an apparatus for ensuring a uniform wind of elongate sheet material onto a reel or hub.

It is a further object of the instant invention to provide a method for ensuring a uniform wind of elongate sheet material onto a reel or hub.

It is a still further object of the instant invention to provide an apparatus and method for ensuring a uniform diametral wind of plastic bottle carriers onto a reel or hub.

It is a still further object of the instant invention to provide a method and apparatus for ensuring a uniform wind of elongate sheet material onto a reel by laterally reciprocating the strip material as it is wound onto a reel or hub.

It is a still further object of the instant invention to provide a method and apparatus for simultaneously reciprocating a plurality of elongate sheets of material as they are wound onto reels to ensure winding uniformity.

Further objects and advantages of the instant invention will become apparent by reference to the following description and appended drawings.

DESCRIPTION OF THE PREFERRED EMBODIMENT

Figure 1:
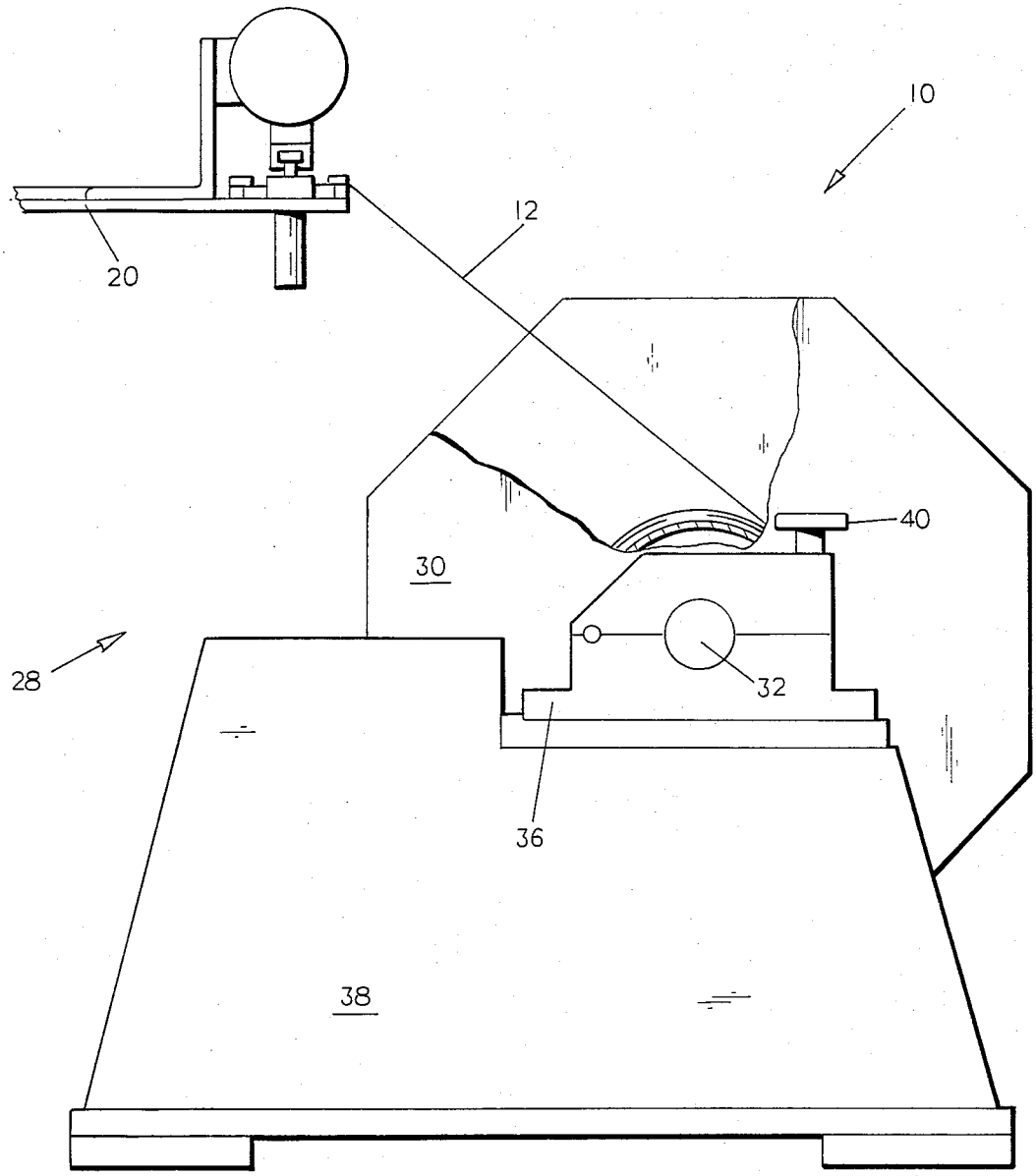
FIG. 1 is a side elevational view of a sheet winding apparatus according to the instant invention.
Figure 2:
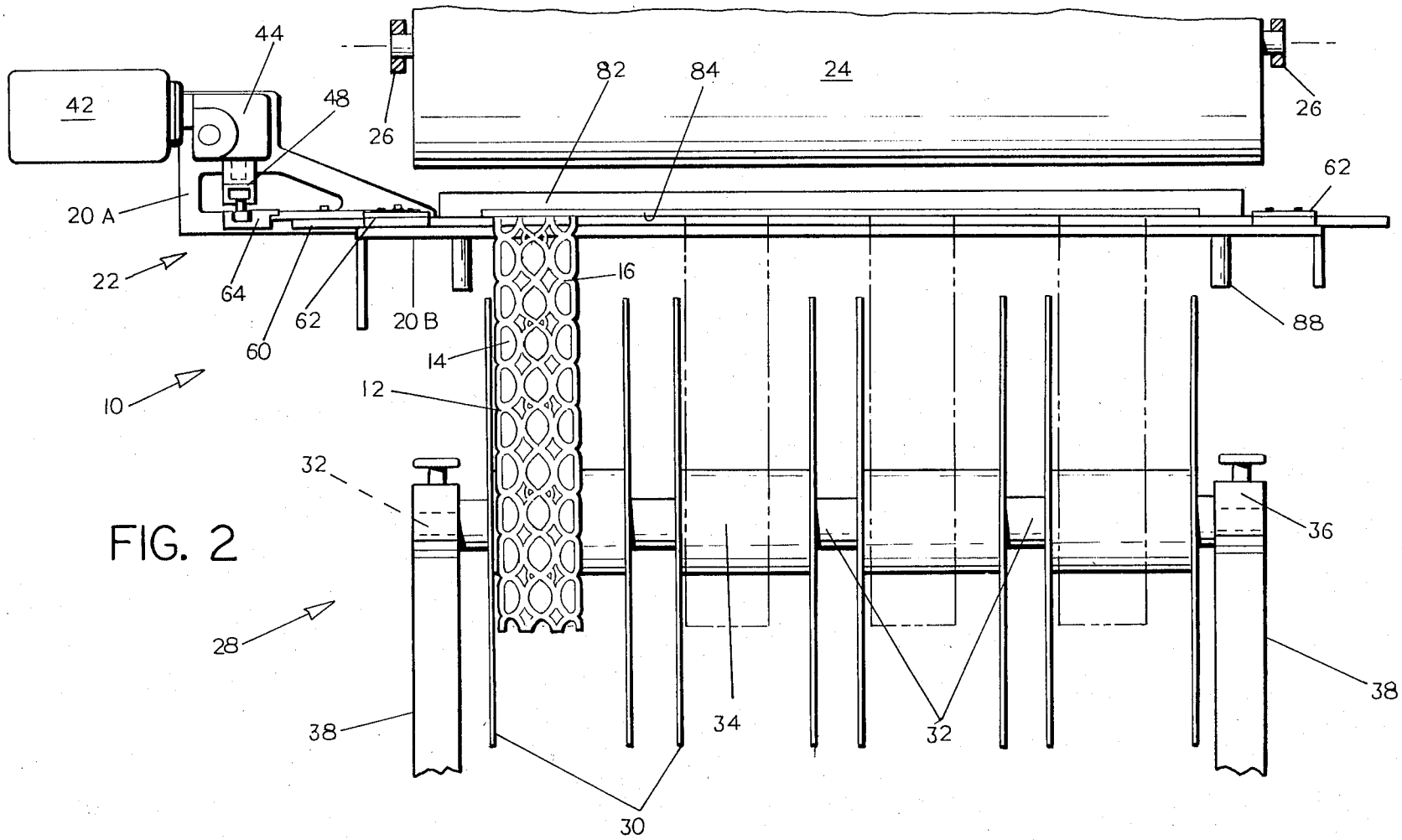
FIG. 2 is an end elevational view of a sheet winding apparatus according to the instant invention.
Figure 3:
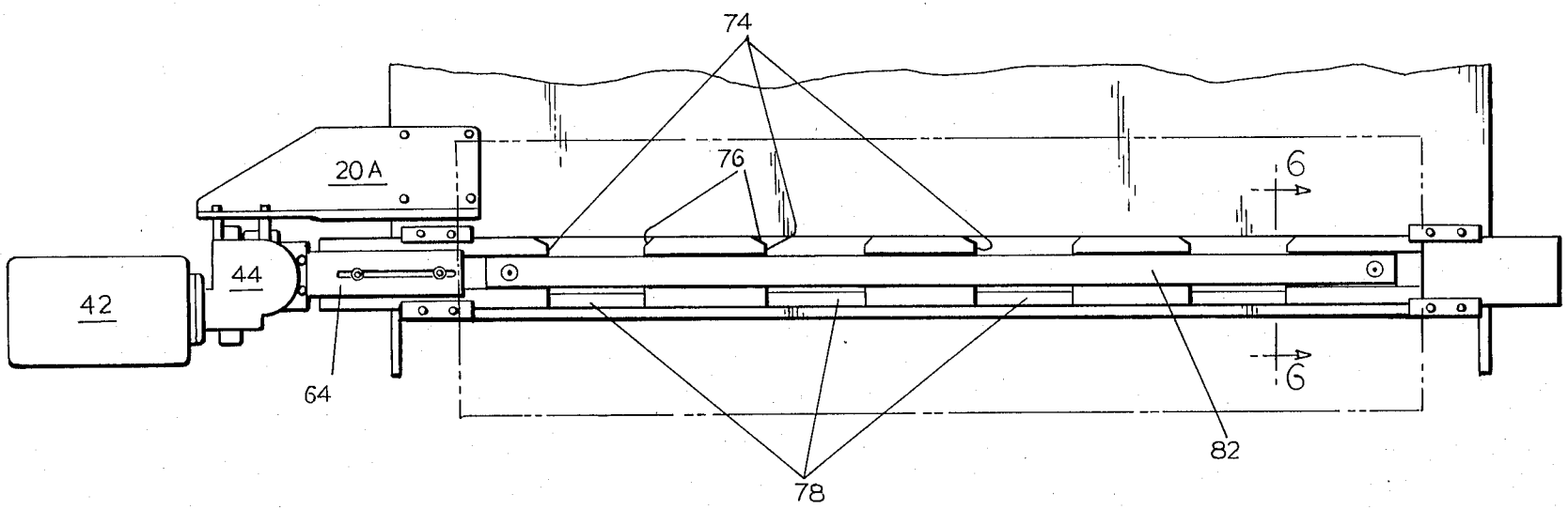
FIG. 3 is a top, plan view of a sheet winding apparatus according to the instant invention.

Referring now to FIGS. 1 and 2, an elongate sheet winding assembly is illustrated and generally designated by the reference numeral 10. The winding assembly 10 is disposed at the terminal portion of a production line (not illustrated) which produces a plurality of elongate strips or sheets 12 having various apertures 14 and lattice-work or webbing 16 defined thereby. The apertures 14 may provide a container or bottle receiving function, as noted, or serve a similar purpose and the webbing 16 may function as a handle or gripping means, also as noted. Inspection of the sheets 12 will render it immediately apparent that the apertures 14 generally occupy a greater percentage of the total area of the sheet 12 than does the lattice-work or webbing 16 and therefore that the sheets 12 exhibit substantially less resistance to skewing and twisting than would a solid sheet of the same material. Typically, a plurality of the sheets 12 will exit the production line. For purposes of convenience and example, four of the sheets 12 are illustrated exiting the production line in FIG. 2 but more or fewer or the sheets 12 may be so produced and it should be understood that the instant invention will function readily and with equal efficacy with a production line producing substantially any number of the sheets 12.

The sheets 12 exit the production line adjacent a horizontal member 20 which may form a portion of the support structure of the production line. Adjacent the end of the horizontal member 20 is a mechanical shuttle assembly 22. Directly above the shuttle assembly 22 is disposed a backwind drum 24 which extends across the full width of the production line and specifically the plural sheets 12 exiting therefrom. The backwind drum 24 is supported for rotation on suitable journal bearings 26. Adjacent and generally below the shuttle assembly 22 is disposed a takeup assembly 28. The takeup assembly 28 includes a plurality of hubs or reels 30 disposed about and coupled to a drive shaft 32 by friction or eddy current clutches 34. The drive shaft 32 is in turn supported on a pair of journal bearings 36 which are mounted upon suitably constructed support members 38. The journal bearings 36 are of hinged, bipartite construction which open to permit release of the drive shaft 32 as required to remove the reels or hubs 30 which have been filled with the sheets 12 and secure empty reels 30 to receive additional material during the production and winding operation. As such, the journal bearings 36 each include a threaded release member 40 or similar structure which selectively secures and releases the two halves of the journal bearings 36 to one another.

Figure 4:
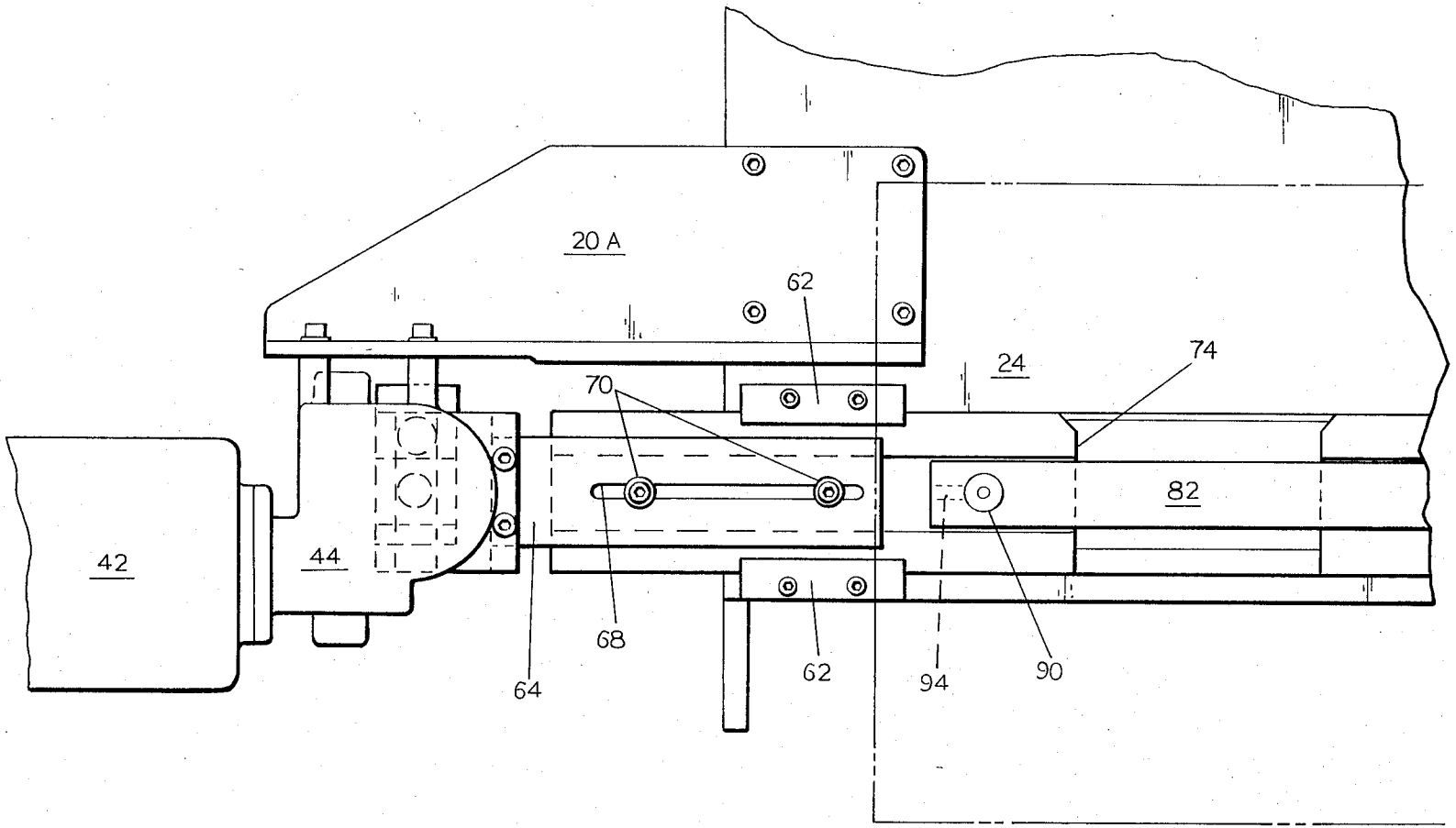
FIG. 4 is an enlarged, fragmentary top plan view of a drive assembly and shuttle bar assembly of a sheet winding apparatus according to the instant invention.
Figure 5:
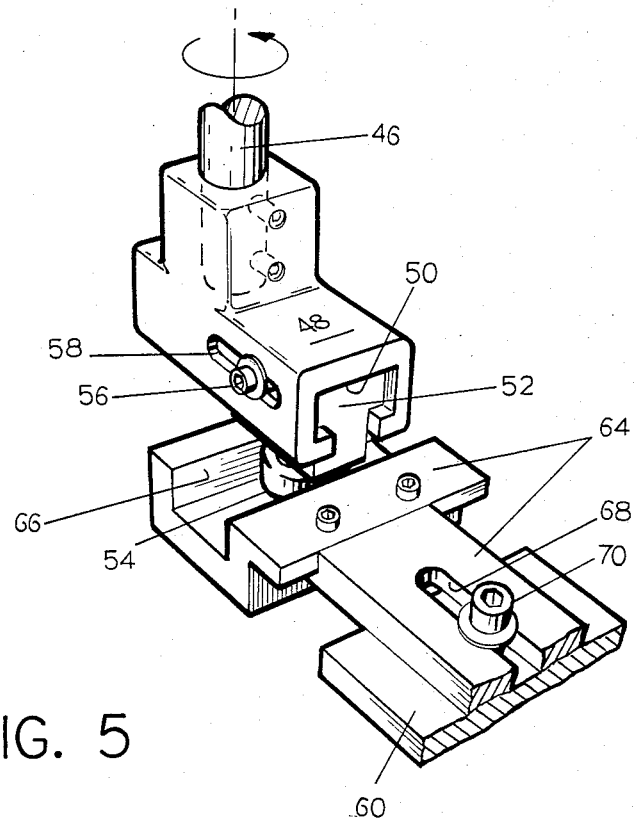
FIG. 5 is a perspective view of a portion of the drive assembly of a sheet winding apparatus according to the instant invention.

Referring now to FIGS. 2, 4 and 5, the shuttle assembly 22 include a prime mover such as an electric motor 42 having a drive shaft (not illustrated) coupled to a speed reducing mechanism 44. Electricity is supplied to the electric motor 42 by a variable voltage controller (not illustrated) such as an SCR controller or similar device in order to provide adjustable rotational speed output of the motor 42. The speed reducing mechanism 44 includes an output shaft 46 to which an eccentrically rotating output member 48 is secured. The output member 48 defines an elongate cavity 50 within which is slidably received an adjustable follower block 52 having a cam follower 54 such as a roller bearing rotatably secured thereto. The axes of rotation of the output shaft 46 and the cam follower 54 are parallel and the radial separation of their axes may be adjusted and fixed by sliding the follower block 52 within the cavity 50 and securing it at a desired radial position by means of a threaded member such as a bolt 56 which passes through a slot 58 in the output member 48 and is received in a complementarily threaded opening (not illustrated) in the follower block 52. The motor 42 and the speed reducing mechanism 44 may be secured by conventional fasteners or similar means to a suitable mounting plate 20A which is in turn secured to the support member 20 or other suitable rigid structure.

Referring now to FIGS. 2, 4 and 5, the shuttle assembly 22 also includes a horizontal laterally extending support 20B which extends across the full width of the production line and encompasses all of the sheets 12 and supports a shuttle bar 60. The shuttle bar 60 likewise extends laterally across the full width of the production line. A plurality of shuttle guide blocks 62 or similar inverted L-shaped structures secured to the support member 20B engages opposed vertical sidewalls of the shuttle bar 60 and constrains it to translation along its long dimension. At one end of the shuttle bar is disposed an adjustable bracket 64 which defines a groove 66 which receives cam follower 54 disposed on the follower block 52 of the output member 48. The groove 66 is preferably disposed perpendicularly to the long dimension of the shuttle bar 60. Rotation of the output member 48 and eccentric motion of the cam follower 54 reciprocate the shuttle bar 60 as those familiar with such mechanical movements will readily appreciate. The adjustable bracket 64 also defines a slot 68 which receives a pair of threaded adjustment bolts 70. The bolts 70 may be loosened, the shuttle bar 60 moved relative to the bracket 64 and then resecured to the shuttle bar 60 in order to adjust the absolute lateral position about which the shuttle bar 60 reciprocates.

Figure 6:
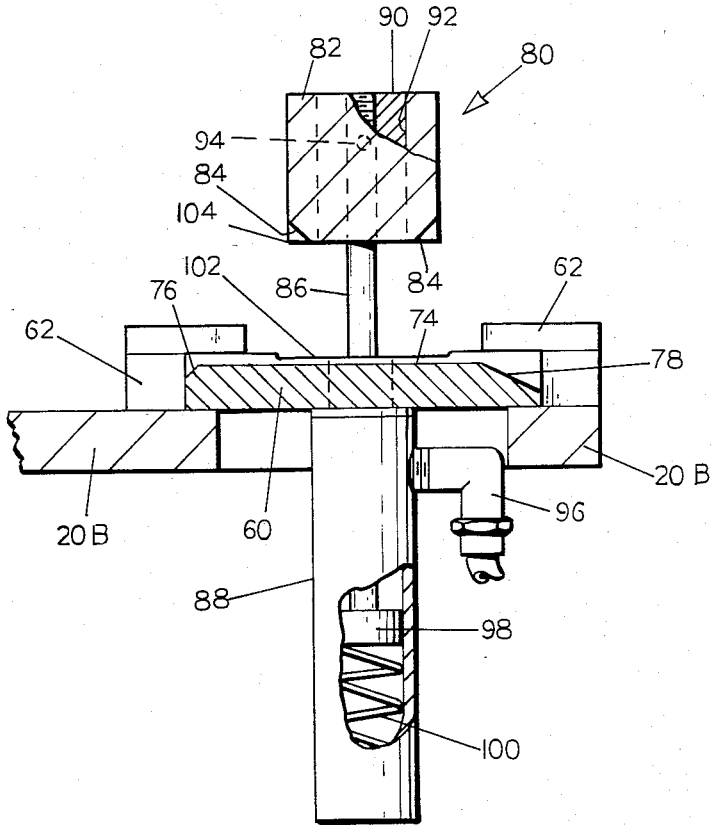
FIG. 6 is a fragmentary, sectional view of the shuttle bar assembly of the instant invention taken along line 6—6 of FIG. 3.

Referring now to FIGS. 4 and 6, the shuttle bar 60 defines a plurality of channels 74. Each of the channels 74 is just slightly wider than the width of the sheets 12 and has compound inner surfaces. First of all, the channels 74 are cut into the shuttle bar below the upper surface thereof as illustrated in FIG. 6. The channels 74 furthermore each define a chamfered inlet edge 76 adjacent the edge of the shuttle bar 60 facing the production line. Adjacent each of the ends of the channels 74 opposite the chamfered edges 76 is a throat region 78 which tapers downwardly and outwardly. Secured to the shuttle bar 60 for reciprocation therewith is a hold-down assembly 80 which includes an elongate retaining bar 82 having lower chamfered faces 84. The retaining bar 80 is mounted for bidirectional vertical translation upon a pair of piston rods 86 which form a portion of a like pair of single acting, spring return pneumatic cylinder assemblies 88. A cylindrical slug 90 is secured to each of the piston rods 86 by suitable means and is received within a complementarily sized opening 92 in the retaining bar 82. A set screw 94 or similar device disposed in the retaining bar 82 secures same to the slug 90 and piston rod 86. As noted, the pneumatic cylinder assemblies 88 are preferably of the single acting, spring return type and include an inlet fitting 96 which supplies compressed air to the upper side of a piston 98 to drive the pistons 98, the piston rods 86 and the retaining bar 82 downwardly toward the shuttle bar 60. When such compressed air is released, springs 100 return the just delineated components to the position illustrated in FIG. 6. The shuttle bar 60 also defines a shallow groove 102 on its upper surface which generally receives and registers with unchamfered terminal portions 104 of the retaining bar 82.

Referring now to all of the drawing figures, the operation of the elongate sheet winding assembly 10 will now be described. The sheets 12 issue from the production line in horizontal, side by side disposition generally on or slightly above the horizontal member 20. Assuming terminal portions of the sheets 12 are issuing from the production line, they must first of all be threaded through the shuttle bar 60 and more specifically through the channels 74 cut thereinto. This is achieved by appropriately activating the hold-down assembly 80 in order to translate it vertically away from the shuttle bar 60. In the embodiment disclosed, this is achieved by releasing compressed air from the pneumatic cylinder assemblies 88 such that the springs 100 raise the retaining bar 82. The sheets 12 may now be threaded through the region between the shuttle bar 60 and the retaining bar 82, and placed within the channels 74. The retaining bar 82 is now lowered by appropriate steps such as application of compressed air to the pistons 98 in order to retain the sheets 12 within the channels 74. Next, the sheets 12 are secured to the reels or hubs 30. Finally, the electric motor 42 is activated and power is supplied to the drive shaft 32 to begin the winding operation.

As has previously been stated, the speed of reciprocation of the shuttle 60, the total lateral reciprocation of the shuttle 60 and the center about which such reciprocation occurs may all be adjusted. The speed of reciprocation is readily adjusted by adjustment of the supply of electrical power to the electric motor 42 by a voltage controller. Inasmuch as this aspect is deemed to be well within the knowledge of one skilled in the art it will not be further discussed other than to state that this adjustment may be made while the winding function is occurring. This is desirable and may be utilized in order to determine the combination of feed rate of the sheets 12 and reciprocation rate of the shuttle bar 60 which provide the optimum wind. The total reciprocation length may be adjusted by adjusting the eccentricity of the output member 48 and specifically by loosening the bolt 56 such that the follower block 52 and ball bearing 54 may be moved toward the axis of the output shaft 46 to reduce the reciprocation of the shuttle bar 60 and moved radially outwardly from the axis of the output shaft 46 to increase the reciprocation of the shuttle bar 60. Finally, the center about which the shuttle bar 60 reciprocates may be adjusted by loosening the threaded adjustment bolts 70, moving the shuttle bar 60 relative to the bracket 64 in order to place the center of reciprocation of the shuttle bar 60 at the desired position and, finally, retightening the threaded adjustment bolts 70.

As the sheet material 12 winds onto the hubs or reels 30, the shuttle bar 60 is reciprocated as appropriate to ensure a smooth uniform wind on the reels 30 and that they are filled to the maximum. When the reel or hub 30 is filled, the sheet material 12 may be severed at a location generally adjacent the take up assembly 28. The ends of the sheet material 12 are then secured to the adjacent layers of the material 12 on the reels 30, and the reels 30 are removed from the drive shaft 32 and empty reels 30 are installed upon the drive shaft 32 preparatory to receiving more of the sheet material 12. As it has been found uneconomical to shut down the production line and punching operations during the exchange of reels 30, the sheet material 12 will continue to issue from the production line and through the shuttle assembly 22. During this time, the back wind drum 24 is utilized to receive and wind the sheet material 12. When the new reels or hubs 30 are ready to receive the sheet material 12 a lateral fold is made in the sheet material 12, this fold is secured to the reel 30 and the material 12 is wound from both the production line and the back wind drum 24 until the material 12 on the back wind drum 24 has been wound onto the reel 30.

While it should be understood that material width, material winding rates, and shuttle reciprocation rates may vary over broad ranges, the following example will illustrate the general parameters. The example, however, should not be considered to be limiting in any manner. One popular style of bottle carrier uses a sheet having a width of approximately $5\frac{1}{2}$ inches. The internal width of a reel 30 suitable for such material is preferably about 7 inches. The output member 48 of the shuttle assembly 22 is adjusted to provide from $1\frac{1}{8}$ inches to $1\frac{1}{4}$ inches of lateral reciprocation and the speed of the electric motor 42 is adjusted to provide one full cycle of reciprocation of the shuttle bar 60 in from 9 to 11 seconds and preferably about 10 seconds. The reel 30 will rotate at approximately 150 rpm although it should be understood that this figure is highly approximate inasmuch as the sheet 12 exits the production line at a constant linear speed and that the actual rotational speed of the reels 30 will depend upon the amount of material in one revolution. It is anticipated that cycle reciprocation times of the shuttle bar 60 in the range of from 1 to 30 seconds will provide suitable even winding of sheet materials in the great majority of applications. It should be understood that the instant invention will find application with a broad range of generally planar sheet materials which have heretofore been difficult to coil or wind onto reels or hubs for shipment and for other purposes.

The foregoing disclosure is the best mode devised by the inventor for practicing this invention. It is apparent, however, that methods and apparatus incorporating modifications and variations will be obvious to one skilled in the art of material handling. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. An apparatus for facilitating uniform winding of sheet material comprising, in combination a shuttle member having at least one material receiving channel disposed therein, said channel having a width substantially equal to the width of said sheet material, a retaining member extending across said channel, said retaining member disposed for movement between a first position in which said material is retained in said channel and a second position in which said retaining member is spaced from said shuttle member, means for moving said retaining member between first and second positions drive means for reciprocating said shuttle member, and coupling means for interconnecting said drive means and said shuttle member.

2. The apparatus of claim 1 wherein said retaining member is disposed on said shuttle member and reciprocates therewith.

3. The apparatus of claim 1 wherein said channel in said shuttle member defines a chamfered throat region.

4. The apparatus of claim 1 wherein said coupling means includes means for adjusting the reciprocal stroke of said shuttle member and means for adjusting the center about which said shuttle member reciprocates.

5. The apparatus of claim 1 wherein said means for moving said retaining member includes a pair of pneumatic cylinders, one of said pair of cylinders disposed at each end of said retaining bar.

6. The apparatus of claim 1 wherein said retaining member includes a bottom face and a pair of chamfered edges adjacent said bottom face.

7. An apparatus for uniformly winding sheet material comprising, in combination, a shuttle member having one material receiving channel disposed therein, said channel having a width substantially equal to the width of said sheet material, a retaining member extending across said channel, said retaining member disposed for movement between a first position in which said material is retained in said channel and a second position in which said retaining member is spaced from said shuttle member, means for moving said retaining member between said first and said second positions, drive means for reciprocating said shuttle member and said retaining member, coupling means for interconnecting said drive means and said shuttle member, said coupling means including means for adjusting the reciprocal stroke of said shuttle and said retaining member, and means for receiving said sheet material.

8. The apparatus of claim 7 wherein said shuttle member includes a channel means disposed generally normal to said material receiving channel, for receiving said retaining bar.

9. The apparatus of claim 7 wherein said channel in said shuttle member defines a chamfered throat region.

10. The apparatus of claim 7, wherein said means for receiving said sheet material includes at least one reel having an internal width wider than the width of said sheet material.

11. The apparatus set forth in claim 7 including a back wind drum operable to accumulate said sheet material when a takeup device is filled and an empty takeup device is being placed in position to receive sheet material.

12. The apparatus set forth in claim 10 wherein the internal width of said reel is slightly greater than the width of the sheet material.

* * * * *